US006371582B1

(12) United States Patent
Hasegawa

(10) Patent No.: US 6,371,582 B1
(45) **Date of Patent: *Apr. 16, 2002**

(54) DEVICE FOR PREVENTING THIN APPARATUS FROM OVERTURNING

(75) Inventor: Takumi Hasegawa, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/320,645

(22) Filed: May 27, 1999

(30) Foreign Application Priority Data

May 29, 1998 (JP) ..... 10-150113

(51) Int. Cl.[7] ..... A47B 97/00
(52) U.S. Cl. ..... 312/223.3; 312/195; 248/551
(58) Field of Search ..... 312/223.2, 223.3, 312/194, 208.1, 319.1, 312, 196, 319.4; 108/50.01, 50.02; 248/322, 339, 551, 918, 304, 303, 364; 411/400; 70/58

(56) References Cited

U.S. PATENT DOCUMENTS

| | | | | | |
|---|---|---|---|---|---|
| 1,225,797 | A | * | 5/1917 | Gardner | 312/319.4 X |
| 1,888,127 | A | * | 11/1932 | Hearne | 248/304 X |
| 1,942,856 | A | * | 1/1934 | Davis | 312/195 X |
| 2,634,188 | A | * | 4/1953 | Davis | 312/319.4 X |
| 2,768,047 | A | * | 10/1956 | Strauss | 312/319.1 X |
| 3,353,570 | A | * | 11/1967 | Sweat | 248/304 X |
| 4,417,714 | A | * | 11/1983 | Charm | 248/328 X |
| 4,570,156 | A | * | 2/1986 | Nicholas, Jr. | 312/203 X |
| 4,858,878 | A | * | 8/1989 | Gassaway | 248/551 |
| 5,169,114 | A | * | 12/1992 | O'Neill | 248/551 |
| 5,406,809 | A | * | 4/1995 | Igelmund | 70/58 X |
| 5,408,939 | A | * | 4/1995 | Lechman | 312/223.3 X |
| 5,423,507 | A | * | 6/1995 | Florent et al. | 248/339 X |
| 5,572,935 | A | * | 11/1996 | Schairbaum | 312/223.3 X |
| 5,660,451 | A | * | 8/1997 | Glynn | 312/223.2 |
| 5,683,154 | A | * | 11/1997 | Chang | 312/194 |
| 5,738,020 | A | * | 4/1998 | Correia | 248/551 X |
| 5,763,985 | A | * | 6/1998 | Asinovsky | 312/223.3 X |
| 5,836,183 | A | * | 11/1998 | Derman | 70/58 |
| 5,974,840 | A | * | 11/1999 | Kao | 70/58 |

FOREIGN PATENT DOCUMENTS

| | | | | |
|---|---|---|---|---|
| CH | 347318 | * | 8/1960 | 312/195 |
| EP | 347886 | * | 12/1989 | 248/322 |
| FR | 1190221 | * | 10/1959 | 312/195 |
| GB | 2058901 | * | 4/1981 | 248/322 |
| JP | 64-29555 | | 2/1989 | |
| JP | 1-79882 | | 5/1989 | |
| JP | 3-3029 | | 1/1991 | |
| JP | 4-52223 | | 5/1992 | |
| JP | 9-313329 | | 12/1997 | |

* cited by examiner

*Primary Examiner*—James O. Hansen
(74) *Attorney, Agent, or Firm*—Sughrue Mion, PLLC

(57) ABSTRACT

A device for preventing a thin apparatus from overturning by fixing it with a fixing portion of a desk. The device prevents overturn of the thin apparatus, which is a tower type computer, or the like, as the apparatus is fixed to an overhanging part of the desk using a fixture which is a combination of a hook and a U-shaped bracket, when the thin apparatus is disposed in dead space at the back of, the side of, or under the desk.

6 Claims, 2 Drawing Sheets

DEVICE FOR PREVENTING THIN APPARATUS FROM OVERTURNING

BACKGROUND OF THE INVENTION

1. Field of the Invention

The present invention relates to a device for preventing overturn of a standing thin apparatus such as tower type computers, word processors, television tuners, and the like.

This application is based on Japanese Patent Application No. Hei 10-150113, the contents of which are incorporated herein by reference.

2. Description of Related Art

For the purpose of saving space, a thin tower type computer may be set in a space which is normally unused (which is hereinafter called "a dead space") at the back, the side, or the like of a desk. Similarly, a thin apparatus other than a thin computer, for example, a word processor, a television tuner, or the like is often set standing perpendicularly in a dead space. Currently, there is no means to fix a thin apparatus in a dead space, so that it can stand alone in the dead space on or next to the desk.

The center of gravity of a thin apparatus such as a thin computer, word processor, television tuner, and the like is relatively high compared with the contact surface area at the bottom of the apparatus, so that the apparatus tends to overturn when something touches the apparatus, the floor or desk is shaken, or an earthquake occurs. Therefore, there is possibility of overturning when the thin apparatus stands alone in the dead space on or next to the desk.

SUMMARY OF THE INVENTION

In view of the aforementioned, an object of the present invention is to provide a device for preventing a thin apparatus from overturning by providing a means for fixing the thin apparatus with a fixing part of a desk and the like.

To achieve the above object, as a first embodiment, the present invention provides a device for preventing overturn of a standing or an upright apparatus disposed in a dead space at the back of, the side of, or under a desk, comprising at least one fixture connecting the desk and the standing apparatus.

Furthermore, the fixture may comprise a pair of fixtures respectively provided at an overhanging part of the desk and on the standing apparatus.

The standing apparatus may be selected from the group consisting of a tower type computer, a word processor, and a tuner.

A plurality of the fixtures may be provided at two or more points of the overhanging part of the desk and on the standing apparatus.

The fixture may be formed of an elastic material.

The fixture may comprise a hook and a bracket engaging with the hook in a detachable manner, and one of the hook and the bracket is fitted to the desk and the other is fitted to the standing apparatus.

Moreover, as a second embodiment, the present invention provides a desk for preventing overturn of an apparatus standing near the desk, comprising a fixture connecting the desk and the standing apparatus.

The standing apparatus may be fixed with the fixture in a dead space at the back of, the side of, or under the desk.

The apparatus may be selected from the group consisting of a tower type computer, a word processor, and a tuner.

The fixture may be formed of an elastic material.

The desk may comprise an overhanging part provided with the fixture.

The desk may comprise a plurality of the fixtures provided at two or more points on the overhanging part of the desk and the standing apparatus.

The fixture may comprise a hook and a bracket engaging with the hook in a detachable manner, and one of the hook and the bracket is fitted to the desk and the other is fitted to the standing apparatus.

According to the present invention, since the thin apparatus is fixed with the fixture to the overhanging part of the desk or the like, even a thin apparatus which tends to overturn because of a relatively high center of gravity can be prevented from overturning. Therefore, a thin apparatus such as a thin computer and the like can be safely disposed in the dead space of the desk or the like.

DESCRIPTION OF THE PREFERRED EMBODIMENTS

An embodiment of the device for preventing a thin apparatus from overturning of the present invention is explained referring to figures.

Figure 1:
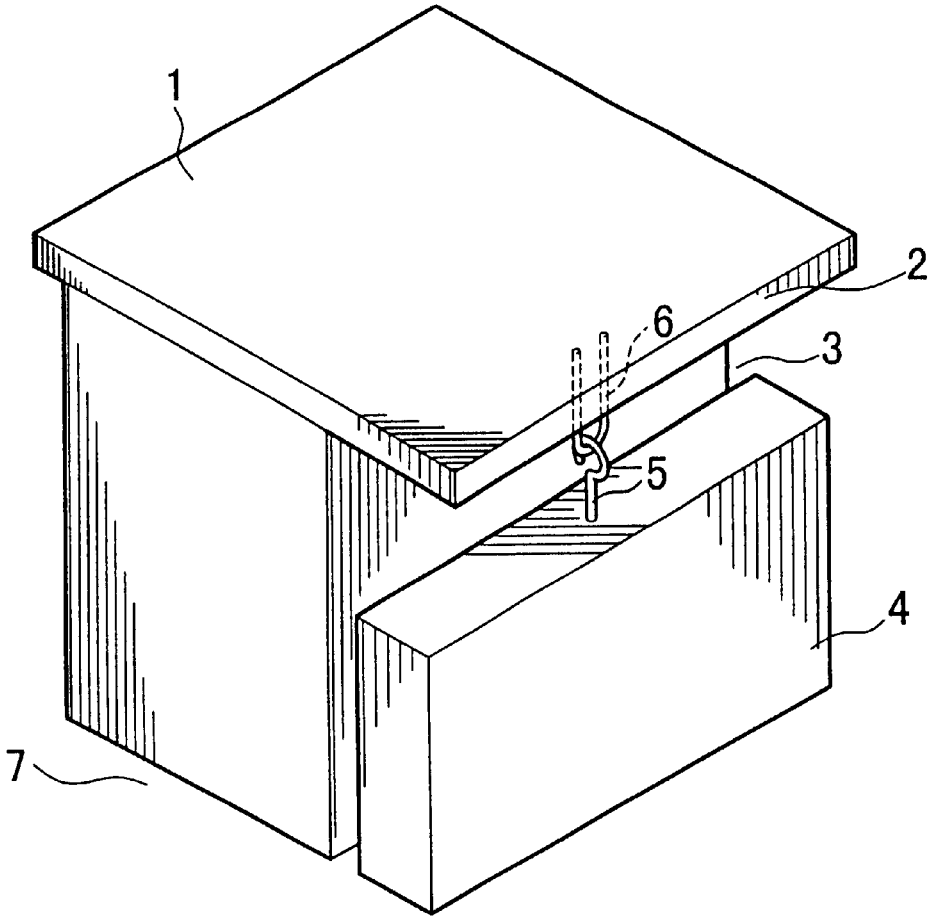
FIG. 1 is a perspective view showing an embodiment of a device for preventing overturn of a standing apparatus of the present invention.
Figure 2:
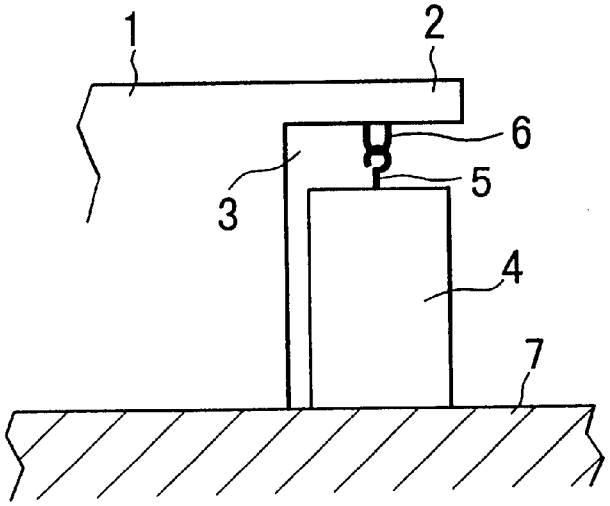
FIG. 2 is a side view of the present invention.

FIG. 1 shows a thin tower type computer 4 which is disposed upright in a dead space 3 below an overhanging part 2 at the back of a desk 1. A hook 5, which is one of the fixtures, is fixed upright at the center of the upper plate of the thin tower type computer 4, while a U-shaped bracket 6, which is the other of the fixtures, is fitted on the bottom face of the overhanging part 2 at a position opposite the hook 5. By hitching the hook 5 to the U-shaped bracket 6, the thin tower type computer 4 is fixed to the desk 1 in a detachable manner. The number of fixing parts is not limited to one, and there may be two or more fixing parts by a combination of the hook 5 and U-shaped bracket 6 at the upper side of the computer 4 and the overhanging part 2. Moreover, the U-shaped bracket 6 may be fitted at the center of the upper plate of the thin tower type computer 4, while the hook 5 may be fixed to the bottom face of the overhanging part 2 at a position opposite the U-shaped bracket 6. Additionally, when the thin type computer 4 is fixed to the desk 1, the computer 4 may be set in contact with the back of the desk 1 or may be set separated from the back of the desk 1. Furthermore, the thin tower type computer 4 and a floor surface 7 may not make contact with each other and the computer 4 may be hung under the overhanging part 2 in a manner separated from the floor surface.

The thin tower type computer 4 has a relatively high center of gravity compared with the contact surface area at the bottom of the computer 4 with the floor surface 7, therefore, it tends to overturn. According to the embodiment of the present invention, the thin tower type computer 4 is fixed with the hook 5 to the U-shaped bracket 6, so that overturn is prevented when something touches the thin tower type computer 4, the floor or the desk is shaken, or an earthquake occurs.

Figure 3:
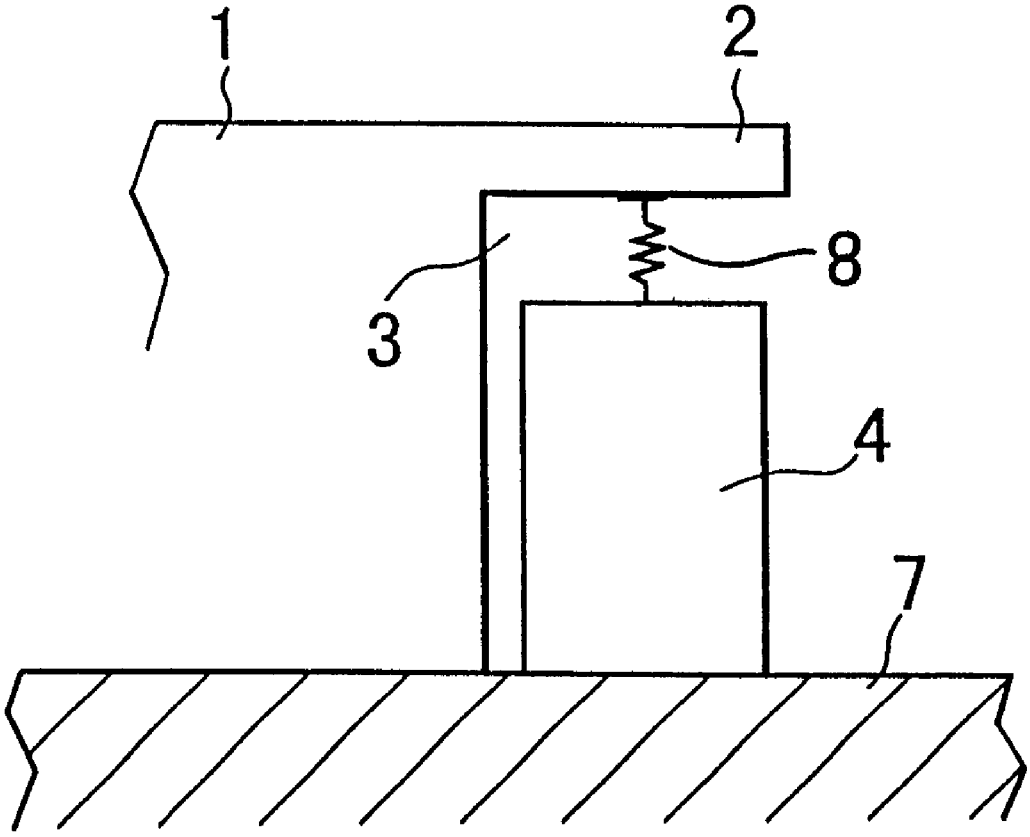
FIG. 3 is a diagrammatical representation of an alternate embodiment of a device for preventing overturn of a standing apparatus of the prevent invention.

In the above embodiment, referring to the figures, an example is explained that the thin tower type computer 4 is set in dead space 3 at the back of the desk 1. However, the computer 4 may be disposed in dead spaces to the side of or under (kneeholes) the desk 1, or in some other dead space. Furthermore, the fixture is not limited to a combination of the hook 5 and the U-shaped bracket 6, so well-known fixtures can be used. For example, as shown in FIG. 3, the thin tower type computer 4 may be pushed from above by the application of the restoring force of an elastic material like a spring 8, so that it may be fixed or semifixed. When the hook 5 and the U-shaped bracket 6 are used as a fixture, the thin tower type computer 4 and the floor surface 7 may not be in contact with each other and the computer 4 may be hung under the overhanging part 2 in a manner separated from the floor surface.

In the above-mentioned embodiment, means for fixing a thin computer 4 is explained, however, the present invention is not limited to the above. The present embodiment can be applied to all thin apparatuses, for example, word processors, television tuners, and the like.

What is claimed is:

1. In combination, a standing apparatus, a desk having an overhanging portion with a bottom surface wherein said desk is supported by a floor surface, and a device for preventing overturn of the standing apparatus resting on said floor surface, the standing apparatus being disposed in dead space at a back of, a side of, or under the desk, the device comprising at least one fixture adapted to connect the bottom surface of the overhanging portion and the standing apparatus, and wherein the standing apparatus is selected from the group consisting of a tower type computer, a word processor, and a tuner.

2. In combination, a standing apparatus, a desk having an overhanging portion with a bottom surface wherein said desk is supported by a floor surface, and a device for preventing overturn of the standing apparatus resting on said floor surface, the standing apparatus being disposed in dead space at a back of, a side of, or under the desk, the device comprising at least one fixture adapted to connect the bottom surface of the overhanging portion and the standing apparatus, and wherein the fixture comprises a hook and a U-shaped bracket engaging with the hook in a detachable manner, and one of the hook and the U-shaped bracket is adapted to fit the desk and the other is adapted to fit the standing apparatus.

3. A device for preventing overturn of a standing apparatus according to claim 2, wherein said U-shaped bracket is made of a rod.

4. In combination, a standing apparatus, a desk having an overhanging portion with a bottom surface wherein said desk is supported by a floor surface, and a device for preventing overturn of the standing apparatus standing near the desk and resting on said floor surface, the device comprising at least one fixture connecting the bottom surface of said overhanging portion and the standing apparatus, and wherein the apparatus is selected from the group consisting of a tower type computer, a word processor, and a tuner.

5. In combination, a standing apparatus, a desk having an overhanging portion with a bottom surface wherein said desk is supported by a floor surface, and a device for preventing overturn of the standing apparatus standing near the desk and resting on said floor surface, the device comprising at least one fixture connecting the bottom surface of said overhanging portion and the standing apparatus, and wherein the fixture comprises a hook and a U-shaped bracket engaging with the hook in a detachable manner, and one of the hook and the U-shaped bracket is fitted to the desk and the other is fitted to the standing apparatus.

6. A combination according to claim 5, wherein said U-shaped bracket is made of a rod.

* * * * *